US006998558B2

(12) United States Patent
Forella et al.

(10) Patent No.: US 6,998,558 B2
(45) Date of Patent: Feb. 14, 2006

(54) SUPPRESION OF MAIL ADDRESSING ERRORS USING EXTENDED CLIENT CODES

(75) Inventors: Guy Forella, Saint Peray (FR); François Gillet, Lyons (FR); Emmanuel Miette, Saint Gratien (FR)

(73) Assignee: Solystic, Cedex (FR)

( * ) Notice: Subject to any disclaimer, the term of this patent is extended or adjusted under 35 U.S.C. 154(b) by 466 days.

(21) Appl. No.: 10/220,633

(22) PCT Filed: Apr. 2, 2001

(86) PCT No.: PCT/FR01/00972

§ 371 (c)(1),
(2), (4) Date: Sep. 4, 2002

(87) PCT Pub. No.: WO01/74502

PCT Pub. Date: Oct. 11, 2001

(65) Prior Publication Data

US 2003/0089643 A1 May 15, 2003

(30) Foreign Application Priority Data

Apr. 5, 2000 (FR) ..... 00 04338
Nov. 23, 2000 (FR) ..... 00 15112

(51) Int. Cl.
*B07C 5/00* (2006.01)

(52) U.S. Cl. ..... 209/584; 209/3.3; 209/900; 700/224; 700/226

(58) Field of Classification Search ..... 209/583, 209/584, 900, 3.3; 700/223, 224, 226, 227
See application file for complete search history.

(56) References Cited

U.S. PATENT DOCUMENTS

| | | | | |
|---|---|---|---|---|
| 4,992,649 | A | 2/1991 | Mampe et al. | |
| 5,031,223 | A * | 7/1991 | Rosenbaum et al. | 382/101 |
| 5,072,401 | A * | 12/1991 | Sansone et al. | 700/219 |
| 5,292,004 | A * | 3/1994 | Cesarini | 209/3.1 |
| 5,387,783 | A * | 2/1995 | Mihm et al. | 235/375 |
| 5,781,634 | A | 7/1998 | Cordery et al. | |
| 5,925,864 | A * | 7/1999 | Sansone et al. | 235/375 |
| 6,826,446 | B1 * | 11/2004 | Volta | 700/224 |

FOREIGN PATENT DOCUMENTS

| | | | |
|---|---|---|---|
| EP | 0424728 | A2 | 5/1991 |
| EP | 613731 | A1 * | 9/1994 |
| EP | 1129792 | A1 * | 9/2001 |

* cited by examiner

*Primary Examiner*—Donald P. Walsh
*Assistant Examiner*—Joseph C. Rodriquez
(74) *Attorney, Agent, or Firm*—Sughrue Mion, PLLC

(57) ABSTRACT

In order to eliminate addressing errors on postal articles in a process (8, 10) of sorting, routing, and delivery performed by a postal operator on mail articles (3') handed over to the operator by a sender of mail articles constituting a client of the postal operator, respective mail article identity numbers (I) are generated for the mail articles to be processed in the sorting, routing, and delivery process, said identity numbers (I) being applied to the respective mail articles in machine readable form (5) and being recorded in an electronic file (F) in association with data (A) giving the postal addresses of the mail articles. These mail article identity numbers (I) or "extended client codes" are generated by the mail article sender and they are applied by the sender to the mail articles prior to handing them over to the postal operator. The file (F) containing the mail article identity numbers in association with the data giving postal addresses is also prepared by the sender of mail articles and is transmitted by the sender to the postal operator.

11 Claims, 2 Drawing Sheets

SUPPRESION OF MAIL ADDRESSING ERRORS USING EXTENDED CLIENT CODES

BACKGROUND OF THE INVENTION

The invention relates to routing and delivery sorting of mail articles in one or more sorting offices of a postal operator. In some countries, postal sorting offices allow the senders of bulk mail, i.e. clients of the postal operator, to apply to each mail article a bar code representative of a delivery address code obtained by encoding the postal address of the mail article, said address code indicating a postal delivery point for the mail article being known as the "client code". In a postal sorting office, during the process of subjecting a large batch of such marked mail articles to routing and delivery sorting, each mail article can be processed on the basis of a machine reading the bar code on the mail article. This provides a major saving in time for the postal sorting office and gives the sender, the postal operator's client, the option of benefiting from reduced postage rates.

The address code or client code for a mail article is conventionally generated by the sender on the basis of a machine inputting an image of the postal address of the article, followed by applying optical character recognition (OCR) to the characters in the image as input in order to extract information relating to the postal address of the mail article, followed by automatic processing of the address information in order to generate the address code. This processing typically makes use of a file in which reference address information is put into correspondence with reference address codes supplied by the postal operator. It has been found that the senders of bulk mail do not always have up-to-date reference address information files matching the respective reference address codes. This results in the postal sorting office finding addressing errors in the mail articles. This situation is particularly expensive for a postal operator since an addressing error leads to the postal sorting office recovering the wrongly addressed mail article only after the routing and delivery sorting process has been performed, with the article then either being returned to the sender, or by default being processed manually while ignoring the address code as generated by the sender. That type of error can affect a non-negligible fraction (sometimes as much as 6% to 10%) of a batch of mail articles delivered to a postal sorting office by a sender.

Patent document U.S. Pat. No. 4,992,649 discloses a method of processing mail articles in which the postal operator generates a mail article identity number for each mail article to be processed. The identity numbers are applied to the corresponding mail articles in the form of machine-readable markings, and they are recorded in an electronic file in association with data giving the postal addresses of the mail articles, said data optionally being a digital image of the postal address of each mail article. Such marking of mail articles with mail article identity numbers makes it possible to eliminate the use of delay loops through which each mail passes while waiting for processing in an installation for video-encoding mail articles.

Patent document EP-0 424 728 discloses another method of processing mail articles in which the identity numbers of mail articles are generated by a postal operator and are applied to the corresponding mail articles, while also being recorded in an electronic file in association with the image of the postal address of the mail article. On the basis of that file which can be transmitted over a network from a routing sorting office to a delivery sorting office of the postal operator, it is possible for the routing postal sorting office to begin by computing routing sort codes corresponding to the mail articles listed in the file. On this basis of this file, a delivery sorting office calculates delivery sorting codes or address codes.

Patent document FR-2 646 364 discloses another method of processing mail articles in which the identity numbers of mail articles are generated by a postal operator and in which an electronic file containing these identity numbers in association with data giving the postal addresses of the mail articles is transmitted over a network from a routing postal sorting office to delivery postal sorting offices.

Having the postal operator generate the identity numbers of mail articles simplifies the video-encoding operations that need to be performed in order to recover from errors in encoding postal addresses on certain mail articles. However it does not make it possible to eliminate erroneous addressing of mail articles because the sender does not always have an up-to-date postal address base.

SUMMARY OF THE INVENTION

The object of the invention is to remedy that drawback.

To this end, the invention provides a method of eliminating addressing errors on mail articles in a process of sorting, routing, and delivery performed by a postal operator on mail articles handed over to the operator by a sender of mail articles constituting a client of the postal operator, in which mail article identity numbers are generated for respective mail articles to be processed in the sorting, routing, and delivery process, said identity numbers being applied to the respective mail articles in a machine-readable form and being recorded in an electronic file in association with data representative of the postal addresses of the mail articles, the method being characterized in that the mail article identity numbers are generated by the sender of the mail articles and are applied by the sender to the mail articles prior to handing them over to the postal operator, and in that said file containing the mail article identity numbers in association with the data giving the postal addresses is also prepared by the sender of the mail articles and is transmitted by the sender to the postal operator.

As a result, it is easy for the postal operator to detect anomalies in the postal addresses generated by the sender of mail articles and to deliver to said sender a file containing corrected postal addresses, where appropriate matching the identity numbers of mail articles so as to enable the sender's postal address base to be updated.

In a particular implementation of the method of the invention, each mail article identity number generated by the sender, referred to as an "extended client code", comprises at least a code identifying the sender and a code identifying the postal operator, thus making it possible to ensure traceability for each marked mail article from preparation by the sender to delivery by the postal operator.

In another particular implementation of the method of the invention, each mail article identity number is applied to the mail article in the form of an alphanumeric code, in two dimensions or preferably in the form of a bar code. By way of example, the bar code can be subdivided into two portions: one portion for identifying the sender and the postal operator, and another for identifying the mail article itself, these two portions corresponding to a single identity number for each article. In the portion of the code identifying the postal operator and the sender, an additional information field may be reserved for encoding commercial or marketing data specific to the sender (for example identifying an advertising campaign).

In yet another particular implementation of the method of the invention, the data giving a postal address in the file is constituted by a digital image of the postal address of said mail article, or by formatted alphanumeric attributes in text code giving the postal address. Such data specifying a postal address can also be constituted by digital images respectively of the lines constituting the postal address, or indeed, for example, by a computer file in which the content of each line of the postal address is recorded in ASCII or other mode. Such alphanumeric attributes of the postal address can be obtained in well-known manner by optical character recognition applied to the digital image of the postal address input by a camera. However, it is preferable for the data to be loaded into a file when the mail article is prepared by means of a software tool that is integrated in the word processing program used for preparing the mail article. The software tool may be conventionally constituted by software for managing a postal address book of the kind that is already present in most word processing programs that run on personal computers. The file containing the data giving the postal addresses of mail articles may advantageously be organized in the form of a database with records containing predefined fields associated with corresponding postal address attributes. The software tool integrated in the word processing program used for preparing mail articles may advantageously be adapted to generate the identity numbers automatically, for example by including a counter that is incremented for each new mail article prepared by the sender. Naturally, the identity numbers can be generated after the mail articles have been prepared and put into envelopes, without going beyond the ambit of the invention.

BRIEF DESCRIPTION OF THE DRAWINGS

An implementation of the method of the invention is described below and represented in highly diagrammatic form in the figures.

DETAILED DESCRIPTION OF THE

Figure 1:
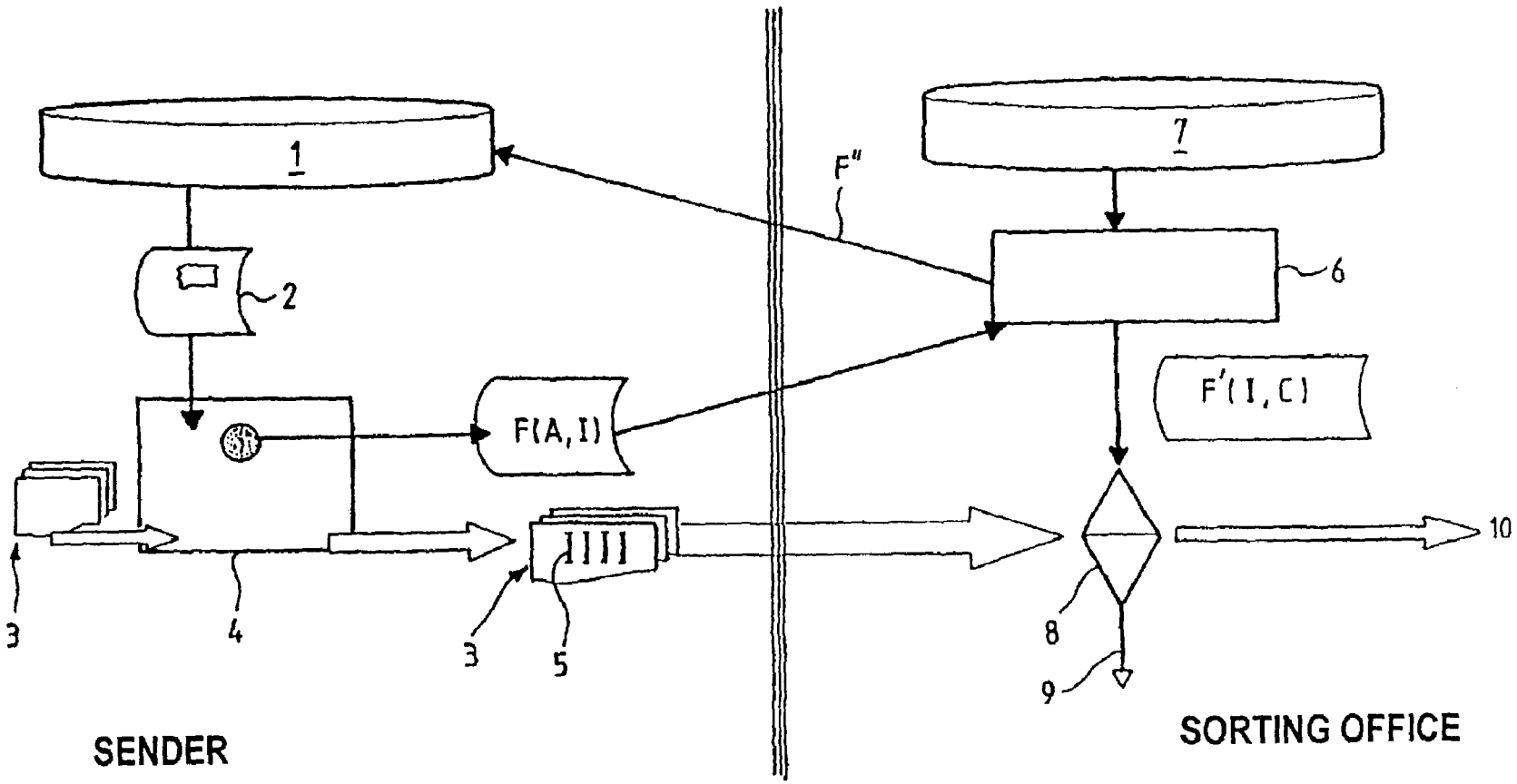
FIG. 1 is a highly diagrammatic representation of the process of identifying mail article identity numbers and of the file containing these numbers in association with postal address data.

On the left-hand side of FIG. 1, there can be seen the process of preparing a batch of mail articles in the premises of a sender of bulk mail, which sender is a client of a postal operator. The sender has a postal address file 1 which is merged with a standard letter 2, e.g. using a word processor program running on a personal computer, so as to prepare a batch of mail articles 3 for delivery by a sorting office of the postal operator.

The batch of mail articles 3 is loaded into a machine 4 on the premises of the sender, which machine automatically inputs a digitized image of the postal address of each mail article and prints on each mail article, an individual marking 5 constituting a client code, e.g. a marking in the form of a bar code representing a unique identifier allocated by the sender to the mail article. This identifier or extended client code can be entirely numerical or it can be alphanumerical.

The digital image of the postal address of each mail article is represented by the letter A in FIG. 1, and the unique identifier of each mail article is represented by the letter I in FIG. 1. As mail articles pass through the machine 4, the machine 4 supplies an electronic file F with the digital image A of the postal address of each mail article, which image is stored in association with the unique identifier I of the mail article as represented by the symbol F(A,I) in FIG. 1. Once the machine 4 has finished processing, the sender has a batch of marked mail articles 3' and a corresponding electronic file F(A,I). As mentioned above, the identifiers I can, in a variant, be generated automatically by a software tool integrated in the word processor program.

The sender transmits the electronic file F(A,I) to the sorting office of the postal operator, e.g. over a telecommunications network which can be the Internet, or by any other equivalent means, and causes the batch of marked mail articles 3' to be handed over in parallel to said postal sorting office. It should be understood that the images A and the identifiers I can be stored in one or more electronic files or in some other data medium that can be used by a computer or the like.

On the right-hand portion of FIG. 1, there can be seen the process of sorting, routing, and delivery as performed in the postal sorting office. The postal sorting office normally receives the electronic file F(A,I) from the sender before receiving the batch of mail articles 3'.

On receiving the electronic file F(A,I), the postal sorting office acts in a step 6 to perform optical character recognition on each digital image A stored in the file F(A,I) in order to extract postal address information and generate, on the basis of up-to-date postal address information held by the postal operator and referenced 7, an address code matching the identifier I of the mail article, said code being referenced C in FIG. 1. The address code C generated by the postal sorting office corresponds in this case to an actual delivery point for the postal sorting office. The operation of optical character recognition is pointless if the data A in the file F is already recorded in text mode.

FIG. 1 shows the address codes C as generated by the postal sorting office and as recorded in association with the identifiers I of mail articles in an electronic file F'(I,C). The process 10 of sorting, routing, and delivering the batch of mail articles 3' is implemented on the basis of the file F'(I,C) as soon as the batch of articles is actually received by the postal sorting office. Prior to implementing the sorting, routing, and delivery process, each mail article is identified and located by machine reading 8 its individual marking 5 in order to obtain its identifier I, and it is sorted, routed, and delivered at 10 on the basis of the association between its identifier I and its address code C as provided by the file F'(I,C). It is possible to place on each mail article some other marking representative of its address code C, for example a bar code, in order to implement the sorting, routing, and delivery process.

A delivery point corresponding to an address code generated at 6 can give rise to a request for re-addressing in the postal sorting office (as happens when an addressee of the mail changes address and has notified a new address with the postal operator). If an address code C generated by the processing 6 is identified as corresponding to an address code for a mail article that needs to be re-addressed, then during machine reading 8 of the individual marking 5 of the mail article, whenever a re-addressed mail article is identified and located on the basis of the association between its identifier I and its address code C as supplied by the file F'(I,C), the article for re-addressing is separated out in 9 from the batch of mail articles. Video-encoding can then be performed on said mail article for re-addressing in order to validate the identity and the exact address of the addressee.

In similar manner, during the processing 6, if the optical character recognition performed on the digital image of the postal address of a mail article cannot be carried through successfully, then the mail article is identified at 8 in the same manner as that described above and is separated out from the batch of mail articles so that video-encoding can be performed thereon.

Postal address anomalies, in particular those that stem from re-addressing as detected by the postal sorting office can, where appropriate, be communicated to the sender of bulk mail, as represented by arrow F" in FIG. 1, so as to enable the sender's own postal address file to be updated.

In a variant, the machine 4 on the premises of the postal sorting offices client processes the digital image A in order to use optical character recognition to extract attributes of the postal address printed on the mail article and contained in the image A: post code, town, street name, street number, and it loads this data representative of the postal address in the file F instead of the image A. This step of extracting postal address attributes from the image A which is performed on the premises of the postal sorting office's client contributes to reducing the cost of processing mail in the sorting office in order to generate the address code C. In a variant, the file F takes the postal address attributes directly from the file 1 during the mail merge process with the standard letter 2, thereby eliminating the operation of optical character recognition. Taking postal address attributes directly can advantageously be performed during mail merge by the software tool that is integrated in the word processor program which automatically generates the identifiers of the mail articles.

Figure 2:
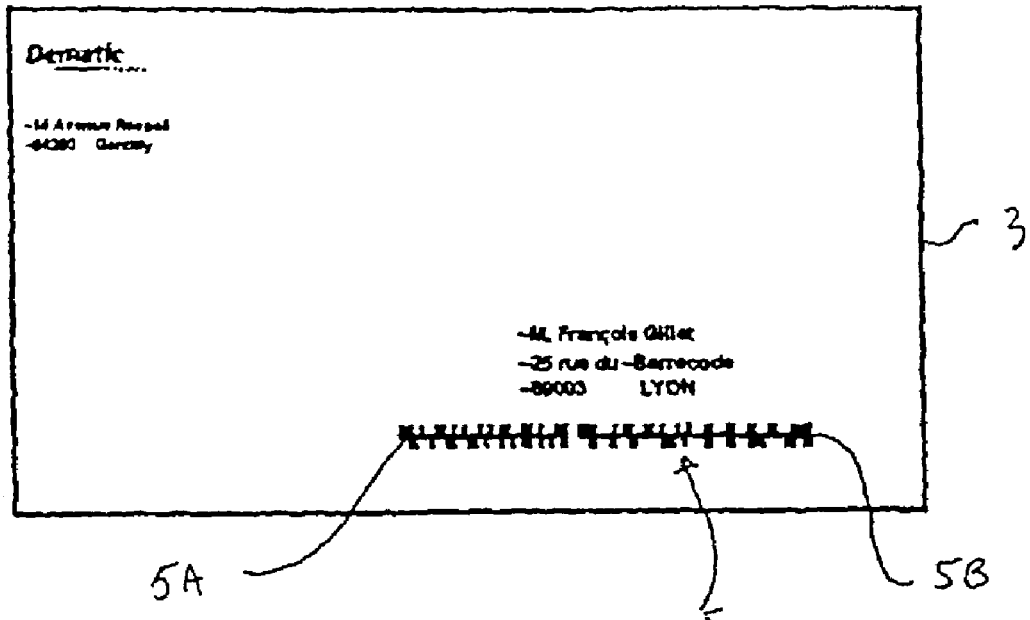
FIG. 2 shows an example of a mail article on which a bar code has been placed that corresponds to a mail article identity number.

FIG. 2 shows a mail article 3' with an example of a bar code 5 that is representative of an identifier I for a mail article as generated by the sender of the mail article. In order to enable mail articles to be traceable, the identifier I generated for each mail article by the sender comprises a code identifying the sender and the postal operator responsible for sorting, routing, and delivering the mail article. In FIG. 2, the bar code 5 is shown as comprising two portions 5A and 5B, the portion 5A corresponding to the identities of the sender and of the postal operator, and the portion 5B corresponding to the identity specific to the mail article.

The method of the invention thus contributes in simple manner to eliminating addressing errors on certain articles of mail in a batch of mail articles transferred in bulk by a sender of mail articles to a postal sorting office.

What is claimed is:

1. A method of eliminating addressing errors on mail articles in a process of sorting, routing, and delivery performed by a postal operator on mail articles handed over to the operator by a sender of mail articles constituting a client of the postal operator, said method comprising the following steps:

generating by said sender of the mail articles, for respective mail articles to be processed by said postal operator, mail article identity numbers, each mail article identity number comprising at least a sender identity code and a postal operator identity code;

applying by the sender these identity numbers to the respective mail articles in a machine readable form prior to handing mail articles over to the postal operator;

recording by the sender said identity numbers in an electronic file in association with data representative of the postal addresses of the mail articles; and transmitting by the sender said electronic file to the postal operator.

2. The method of claim 1, comprising applying each identity number of a mail article to the mail article in the form of a bar code or in the form of a two-dimensional code.

3. The method of claim 1, comprising constituting the data giving a postal address in the file by a digital image of the postal address of said mail article.

4. The method of claim 2, comprising constituting the data giving a postal address in the file by a digital image of the postal address of said mail article.

5. The method of claim 1, comprising constituting the data giving a postal address in the file by alphanumeric attributes of the postal address formatted in text code.

6. The method of claim 2, comprising constituting the data giving a postal address in the file by alphanumeric attributes of the postal address formatted in text code.

7. The method of claim 1, comprising generating the identity number of a mail article while the mail article is being prepared by the sender by using a software tool integrated in the word processor program used for preparing the mail article.

8. The method of claim 2, comprising generating the identity number of a mail article while the mail article is being prepared by the sender by using a software tool integrated in the word processor program used for preparing the mail article.

9. The method of claim 3, comprising generating the identity number of a mail article while the mail article is being prepared by the sender by using a software tool integrated in the word processor program used for preparing the mail article.

10. The method of claim 5, comprising generating the identity number of a mail article while the mail article is being prepared by the sender by using a software tool integrated in the word processor program used for preparing the mail article.

11. The method of claim 1, comprising applying each identity number of a mail article to the mail article in the form of a bar code or in the form of a two-dimensional code, and further comprising building up said file while preparing the mail article by the sender using said software tool integrated in the word processor program used for preparing the mail article.

* * * * *